US011008530B2

(12) United States Patent
Whiting et al.

(10) Patent No.: US 11,008,530 B2
(45) Date of Patent: May 18, 2021

(54) LUBRICANT TRANSFORMABLE FROM SOLID TO SEMI-SOLID

(71) Applicant: BEST GREEN ANSWERS, LLC, Cedar Falls, IA (US)

(72) Inventors: Todd Whiting, Waterloo, IA (US); Kenneth A. Budke, II, Waterloo, IA (US)

(73) Assignee: Best Green Answers, LLC, Cedar Falls, IA (US)

( * ) Notice: Subject to any disclaimer, the term of this patent is extended or adjusted under 35 U.S.C. 154(b) by 5 days.

(21) Appl. No.: 16/740,555

(22) Filed: Jan. 13, 2020

(65) Prior Publication Data

US 2020/0239807 A1 Jul. 30, 2020

Related U.S. Application Data

(60) Provisional application No. 62/798,310, filed on Jan. 29, 2019.

(51) Int. Cl.

| | |
|---|---|
| ***C10M 169/04*** | (2006.01) |
| ***C10M 109/00*** | (2006.01) |
| ***C10M 125/02*** | (2006.01) |
| ***C10M 177/00*** | (2006.01) |
| ***C10N 50/00*** | (2006.01) |
| ***C10N 40/34*** | (2006.01) |
| ***C10N 50/08*** | (2006.01) |
| ***C10N 50/10*** | (2006.01) |
| ***C10N 70/00*** | (2006.01) |

(52) U.S. Cl.

CPC ..... *C10M 169/04* (2013.01); *C10M 109/00* (2013.01); *C10M 125/02* (2013.01); *C10M 177/00* (2013.01); *C10M 2201/041* (2013.01); *C10M 2290/00* (2013.01); *C10N 2040/34* (2013.01); *C10N 2050/08* (2013.01); *C10N 2050/10* (2013.01); *C10N 2050/14* (2020.05); *C10N 2070/00* (2013.01)

(58) Field of Classification Search

CPC ..... C10M 109/00; C10M 125/02; C10M 169/04; C10M 171/00; C10M 2201/041; C10M 2205/18; C10M 2205/186; C10M 2207/401; C10M 2290/00; C10N 2030/06; C10N 2040/00; C10N 2040/34; C10N 2050/08; C10N 2050/10; C10N 2070/00

See application file for complete search history.

(56) References Cited

U.S. PATENT DOCUMENTS

| | | | | |
|---|---|---|---|---|
| 2,251,528 A | | 8/1941 | Sproule et al. | |
| 2,318,668 A | | 5/1943 | Calkins | |
| 2,442,828 A | | 6/1948 | Smith et al. | |
| 2,534,053 A | | 12/1950 | O'Halloran | |
| 4,242,861 A | * | 1/1981 | Kirksey | D01H 7/62 508/591 |
| 4,508,761 A | * | 4/1985 | Miyoshi | C10M 123/02 427/221 |
| 4,913,263 A | | 4/1990 | Spiers | |

FOREIGN PATENT DOCUMENTS

| | | |
|---|---|---|
| CN | 107603700 A | 1/2018 |
| WO | 2018065361 A1 | 4/2018 |

* cited by examiner

*Primary Examiner* — James C Goloboy

(74) *Attorney, Agent, or Firm* — McKee, Voorhees & Sease, PLC

(57) ABSTRACT

A lubricant composition includes a mixture of grease and wax formed into a block which is solid at atmospheric pressure and temperatures up to 150° F., and which transforms into a semi-solid under mechanical loading. The mixture is formed with 5-25% of melted wax. The block may be coated to form a shell to remain solid at elevated temperatures. The block may include other additives. The grease block is suitable for use in various applications, including on a $5^{th}$ wheel trailer hitch plate.

17 Claims, 7 Drawing Sheets

LUBRICANT TRANSFORMABLE FROM SOLID TO SEMI-SOLID

CROSS-REFERENCE TO RELATED APPLICATIONS

This application claims priority to Provisional Application U.S. Ser. No. 62/798,310, filed on Jan. 29, 2019, which is herein incorporated by reference in its entirety.

FIELD OF THE INVENTION

A solid grease block formed from a mixture of wax and grease provides, easy, no-mess handling and storage. The block transforms into a semi-solid when pressurized, such as by mechanical loading, so as to reduce friction between two surfaces.

BACKGROUND OF THE INVENTION

Grease and other lubricants are often used between two surfaces to minimize friction and wear and prolong the life of the surfaces. For example, a fifth wheel trailer pulled by a truck or a tractor having mating hitch plates will require lubrication between the hitch plates (known as a fifth wheel, for short). Conventional lubricants, such as grease, are difficult and messy to handle. The grease may be applied by a grease gun or from a jar or other container using a rag, brush or other tool. These greases are sticky, difficult to clean off hands, clothing and other objects, and thus require care in handling.

Solid and semi-solid lubricants are known. The terms "semi-solid lubricants" and "semi-solid greases" or simply "greases" will be used substantially interchangeably. Semi-solid lubricants possess certain highly beneficial properties that are suitable for the lubrication needs of what can be described as "sliding surface joint systems". Owing to the crucial functional and environmental design requirements of many of these types of joints, the ability of a semi-solid lubricant to retain its semi-solid form for long periods of time is essential to the longevity of such sliding surface joints.

One of the drawbacks of semi-solid lubricants however is the potential difficulty of applying the lubricant to the intended surfaces. One of the key functional features of greases is that they possess a high level of "tackiness" or "stickiness". While such a feature is indispensable in the ability of the grease to successfully lubricate the sliding surfaces, it at the same time can create a considerable challenge to the operator to properly apply the grease. One especially difficult challenge can be to properly apply grease at low ambient temperatures wherein the grease may exhibit high viscosity.

An example of this juxtaposition of beneficial lubrication properties versus difficulty of application is the lubrication of fifth wheels of commercial and recreational vehicles. A comprehensive review of the challenges of fifth wheel lubrication is described by Jenssen in WO2018065361A1. In brief, the history of prior art encompasses:

- On board positive feed lubrication systems which deliver grease under pressure to the fifth wheel surface;
- Elimination of the need for utilization of the grease itself via use of a polymeric-based "wear plate" with low friction and long life capabilities; and
- Manual methods of grease application with may include the encasement of the semi-solid grease in some type of flexible container or bag. In such case, the containing device is placed onto the fifth wheel surface and is designed to "burst" and release the grease between the fifth wheel surface and the surface of the trailer when the load of the trailer is applied to the fifth wheel.

Spiers patent U.S. Pat. No. 4,913,263 teaches of the use of encasement of a semi-solid grease within a thin walled "packet" which will burst and release its contents when the trailer surface and the vehicle fifth wheel surface come together. The commercial embodiment of the Spiers patent is used routinely by operators for fifth wheel grease servicing. While the U.S. Pat. No. 4,913,263 patent discloses that the encasement device can be made from a bio-degradable material, and that the encasement device might itself be beneficial as a lubricant, actual practice in the marketplace has been to use a plastic material for encasement that does not lend itself to bio-degradation. At some point, the plastic encasement device works its way out of the fifth wheel sliding joint while the truck and trailer are in use. As such, current practice of this commercial product represents a source of litter on roadways.

Jenssen WO2018065361A1 essentially expands on Spiers U.S. Pat. No. 4,913,263 by proposing in a particular embodiment that a number of "packets" be formed together into a "chain of packets". Such a chain of packets allows the operator to apply grease to the fifth wheel surface 1) as a single unit and 2) in a manner that better fits the overall surface shape of the fifth wheel.

Both of these prior art approaches suffer from several drawbacks:

1) the encasing material not only is unbeneficial to the lubrication function of the grease; but likely may interfere with the ability of the fifth wheel joint to be lubricated properly; and 2) the encasing material finds its way out of the fifth wheel joint during in-use service of the vehicle and as a consequence becomes a source of roadway litter, which is highly undesirable.

Thus, there is a need for an improved fifth wheel lubricant solution.

Accordingly, the present invention has the following objectives and beneficial features:

1) prior to application to the sliding surfaces, the lubricant is in a completely firm, solid form that the operator can hold in his hand; that is, the lubricant form is completely "non tacky" or "non sticky;"

2) such solid form of the lubricant is completely "clean" and leaves no residue on the operator's hand; that is, the operator does not have to wear any type of glove when applying the lubricant;

3) such solid form of the lubricant is rigid enough to allow long term safe storage within the cab of the vehicle or otherwise stored on the vehicle;

4) owing to high ambient temperatures that are experienced by such vehicles, the proposed lubricant keeps its solid form under long periods of exposure to such high temperatures;

5) the solid form of the lubricant is very convenient for the operator to apply to the fifth wheel surface; and readily attaches or adheres to the fifth wheel surface;

6) use of the proposed lubricant does not require any type of encasing material, or any type of packaging material of any type, thus eliminating littering of roadways with the spent material;

7) after the proposed solid lubricant has been affixed to the fifth wheel surface, and the weight of the corresponding trailer surface has been applied, the solid lubricant transforms to a semi-solid form which resembles exactly that of a conventional semi-solid grease;

8) then, the semi-solid form of the lubricant continues to perform its function for long periods of time as a fifth wheel lubricant identically to a conventional semi-solid grease composition;

9) in a preferred embodiment of the lubricant, all of the components creating the lubricant are from bio-renewable sources; and 10) in a preferred embodiment of the lubricant, all of the components of the lubricant are readily biodegradable and thus represent the least possible harm to the environment.

SUMMARY OF THE INVENTION

A transformable solid to semi-solid lubricant possesses both the beneficial properties of a semi-solid lubricant which provides the lubrication solution needed by the application, yet is also completely clean and convenient in terms of storage and use by the operator. Furthermore, the new lubricant is preferably produced from bio-renewable materials and is completely bio-degradable.

DETAILED DESCRIPTION OF THE INVENTION

Figure 1:
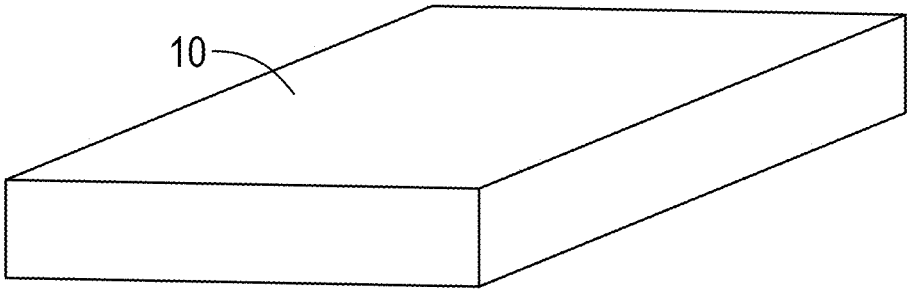
FIG. 1 is a perspective view of a first embodiment of a lubricant pad with no coating applied, according to the present invention.

The lubricant 10 of the present invention exists in both solid and semi-solid forms. Firstly, when the lubricant 10 is created, it is created as a firm, solid form, such as a block or pad. In such a form it does not exhibit the "tacky" or "sticky" surface behavior of conventional semi-solid lubricants. It can therefore be handled by the human hand in the same manner as any common object that exists in a firm solid form. No sticky residue is attracted to the skin when contact is made with the solid lubricant pad; as opposed to the overtly "sticky" behavior of conventional greases. Secondly, after application to the surface or joint to be lubricated, the lubricant transforms to a semi-solid form as the pressure and shear forces of the joint act on the structure of the proposed lubricant. The lubrication properties in the semi-solid form perform precisely as do the lubrication properties of a conventional semi-solid grease.

In a preferred embodiment of the invention, the solid form of the lubricant 10 is created by combining conventional semi-solid grease lubricant with a material which firms the grease into a substantially solid form. The material chosen to firm the grease is utilized in a relatively small percentage in relation to the amount of semi-solid lubricant, so that the beneficial lubrication properties of the semi-solid grease are retained during the ultimate use of the product. The amount of firming material needed depends to an extent on the "firmness" of the semi-solid grease chosen. If the chosen grease is relatively firm, at room temperature, then the amount of firming material required may be reduced. If the chosen grease is "quite soft", the amount of firming material required will be larger.

In the preferred embodiment, the grease to be utilized as the basis for the solid lubricant has been created from renewable materials such as a soy oil-based grease. Also, for the preferred embodiment, the firming material is also a bio-based wax such as a soy wax commonly used in candle making.

In the preferred embodiment of the invention, the solid form of the lubricant 10 is formed by combining (1) a soy oil-based, semi-solid grease formulation 14 with (2) a soy-based wax 16. The soy-based wax has a melting point in the range of 120° F. to 180° F. The soy wax is heated to its melting point. The soy oil-based, semi-solid grease is added and stirred with the melted soy wax. As the grease warms, it becomes itself more fluid-like allowing the soy wax to dissolve into the grease. When the mixture of these two components cools to room temperature, the result is a substantially solid material which is firm to the touch. The extent of the firmness of the solid material is controlled by the relative percentage of soy-based wax utilized to the percentage of soy oil-based grease. Ratios in the range of 5% to 25% soy-based wax versus 75% to 95% soy-based grease are adequate to result in a material which is substantially solid at room temperature. The amount of soy-based wax can be increased to levels higher than 25%. Continually increasing the wax content will accordingly increase the hardness of the solid lubricant and correspondingly reduce the ability of the lubricant to be "spread out" under the normal and shear forces applied by the joint being lubricated.

In another embodiment of the present invention, the solid lubricant is composed of a grease which is not created from bio renewable-based materials. Non-bio renewable-based semi-solid greases commonly utilize a petroleum oil such as mineral oil as the basis for the corresponding grease formulation. The solid lubricant can be further composed of a wax which is a non-bio renewable wax. Such waxes are typically derived from petroleum sources.

The solid lubricant forms as described above can optionally contain the addition of components 18 which will impart additional functionality to the lubricant after its transformation to the semi-solid form. Such additional components can, for instance:

1) enhance the load carrying capability of the base grease component by addition of, for example, a commercially available extreme pressure additive or other commercially available anti-wear additives;

2) enhance the lubricity of the base grease component by addition of, for example, a commercially available graphite in fine powdered form; and 3) provide a desired color to the final product by addition of a commercially available colorant.

In another embodiment of the current invention, the solid form of the lubricant is optionally coated with a layer of material 12 applied to the solid lubricant surface after the mixture of grease and wax has cooled to form an encased block 10A. The coating 12 is applied in cases where the solid lubricant may be subjected to elevated ambient temperatures. Depending on the exact composition of the semi-solid grease used to create the proposed lubricant, the grease itself may exhibit lower and lower viscosity as the ambient temperature increases. As ambient temperatures approach the levels of 125° F., or even higher, the viscosity of the grease component may become so low that the firming material used to firm the grease grows less able to maintain the solid form of the proposed lubricant. The exterior coating 12 of the present invention provides an "encasing shell" around the formed solid lubricant. With such coating applied, the solid lubricant will remain firm to the touch at very elevated ambient temperatures; for example, in the range of 150° F. or higher. In a preferred embodiment of the invention, the coating 12 is created from a bio-renewable material such as a natural flour or a derived natural starch. When a flour or starch is mixed with water and subsequently allowed to dry, it adheres strongly to the surface to which it has been applied. A layer is formed that is relatively strong and dense. The strong and dense layer when applied to the surface of the solid lubricant, further enhances the firmness of the surface of the solid lubricant. Furthermore, the flour or starch layer maintains its structure in an environment of elevated ambient temperatures. Consequently, the overall firmness of the solid lubricant 10 itself is increased substantially at elevated ambient temperatures. In a preferred embodiment of the invention, the solid lubricant coating 12 is produced by mixing soy flour with water. The amount of water added to the soy flour affects the thickness of the coating after the coating dries. In the preferred embodiment, a ratio of approximately 25% soy flour to 75% water by weight produces a paste-like consistency. The coating 12 is then applied to the surface of the solid lubricant 10 with a commercial application technique such as dipping. A simple air-drying process is applied to dry the coating. The coating 12 is preferably a thin layer which becomes pressed into the soft lubricant under pressure, so as to effectively dissolve away in use. The coating enhances the robustness of the block 10A and allows for variations in the internal grease formulations.

The coating as described above can additionally incorporate further components to enhance the functionality of the coating. Such enhancements can provide, for example; 1) additional strength to the coating beyond the capability of the starch base; 2) reduce the permeability of the coating, 3) provide a surface texture which improves handling and 4) colorant options which will allow a final color of choice for the solid lubricant. In a preferred embodiment of the invention, a fine graphite powder is added to the soy flour and water mixture. When dried, the soy flour and graphite combine to create a coating which enables the solid lubricant to remain firm to the touch at ambient temperatures in excess of 150° F. Furthermore, the coating of soy flour and graphite is relatively impervious and will contain the components of the solid lubricant which may become relatively soft to the touch as ambient temperatures approach the range of 150° F. Finally, the addition of graphite acts as a colorant, and in this case, results in a solid lubricant which is black in color.

Another alternative for the coating is a wax material or composition to cover the lubricant. For example, a suitable commercially available wax is available from Clarus Specialty Products (Rock Hill, S.C.), under the name Microblend 35.

In a further embodiment, the coating material to be applied to the solid lubricant described above may be created with an "adherent" material not derived from renewable sources. Such a non-bio renewable material will commonly be derived from a petroleum source. For example, the adherent material can be a liquid adhesive or a semi-solid adhesive; either of which can be air-dried when applied to the surface of the solid lubricant.

Figure 11:
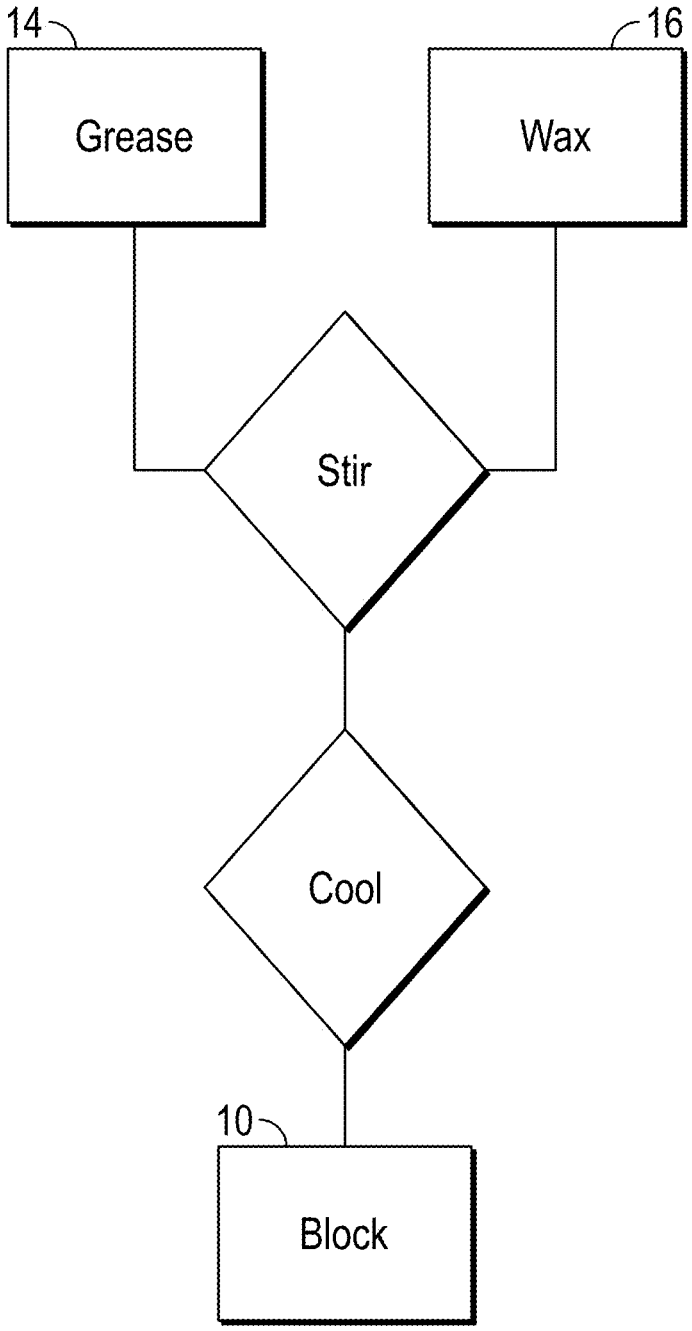
FIG. 11 is a flow chart illustrating the process for making the grease block of the present invention.
Figure 12:
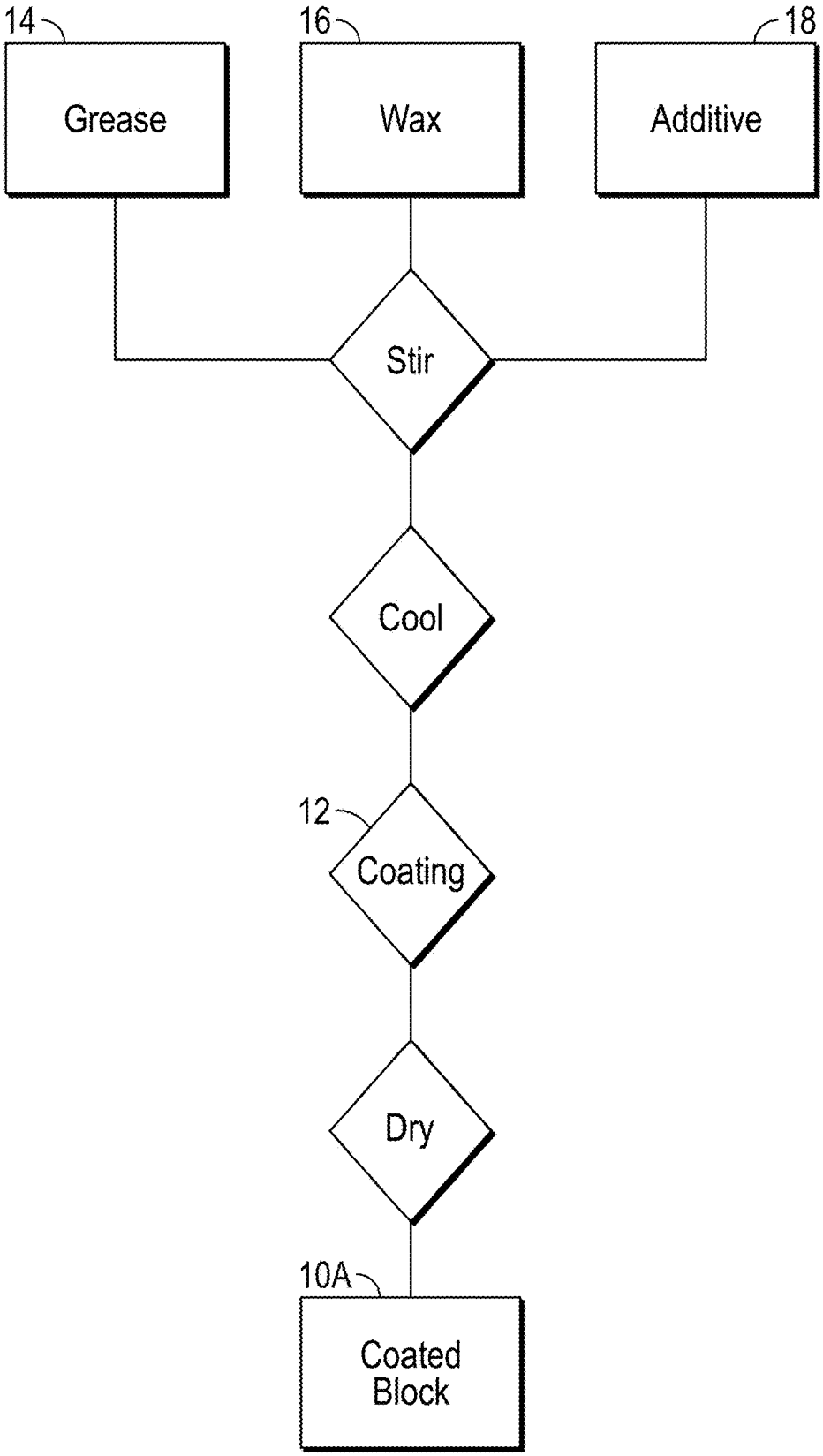
FIG. 12 is a flow chart showing an alternative process for making the grease pad of the present invention.

It is understood that the additive 18 can be used in the process of FIG. 11 without the coating 12, and with the process of FIG. 12 with the coating 12. Similarly, the coating 12 can be used in the process of FIG. 11 without the additives, and in the process of FIG. 12 with the additive.

The solid/semi-solid transformable lubricant offers an ideal solution to the problem of lubrication of fifth wheels of towing vehicles. The invention provides a convenient, clean and easy to apply form of lubricant which will, at the same time, satisfactorily lubricate the fifth wheel for long periods of time. The solid form of the lubricant can be formed into virtually any manner of size and shape. In a preferred embodiment of the invention, FIG. 1 shows the lubricant in solid form to be in a generally square or rectangular shape in the range of 1" to 6" in width, 1" to 6" in length and ⅛" to 1" in thickness. Such a geometrical form of the solid lubricant will henceforth be referred to as a "lubricant pad". The lubricant pad is created according to the methods described above. The lubricant pad is completely firm to the touch and its surface is completely dry at room temperature.

Figure 2:
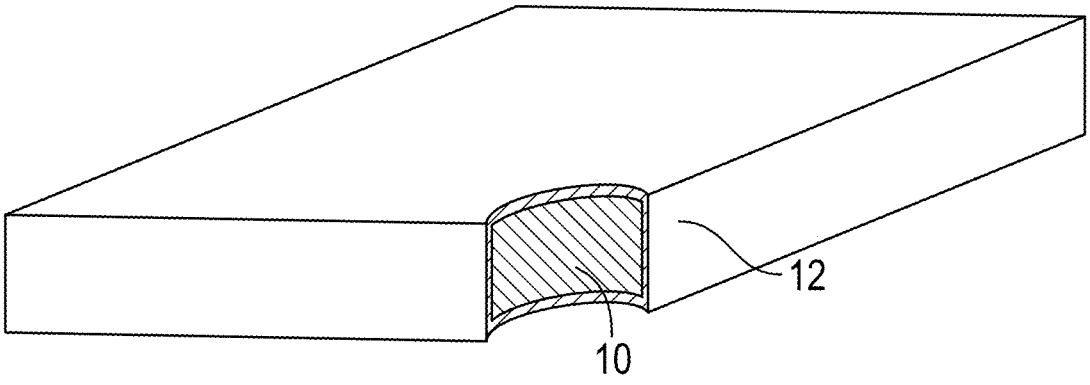
FIG. 2 is a perspective view of a second embodiment of a lubricant pad, with a coating applied, according to the present invention.

FIG. 2 shows the lubricant pad in a form in which an exterior coating has been applied as described above. With such coating applied, the pad will continue to be firm to the touch and the surface will remain dry at ambient temperatures as high as those normally encountered in real world practice. Maximum expected temperatures include the temperature which may be reached inside the cab of a truck which is itself being exposed to high ambient temperatures.

The lubricant pad is self-contained regarding storage and handling by the operator. No added packaging material is required; thus, no packaging material requires disposal. Further, once the lubricant pad has been applied to the fifth wheel surface, no such packaging material will be discarded onto the roadway. The lubricant pad is simply placed onto the surface of the fifth wheel by the operator. The fifth wheel most commonly has an existing thin layer of prior-used grease on its surface to which the lubricant pad will readily adhere.

Figure 3:
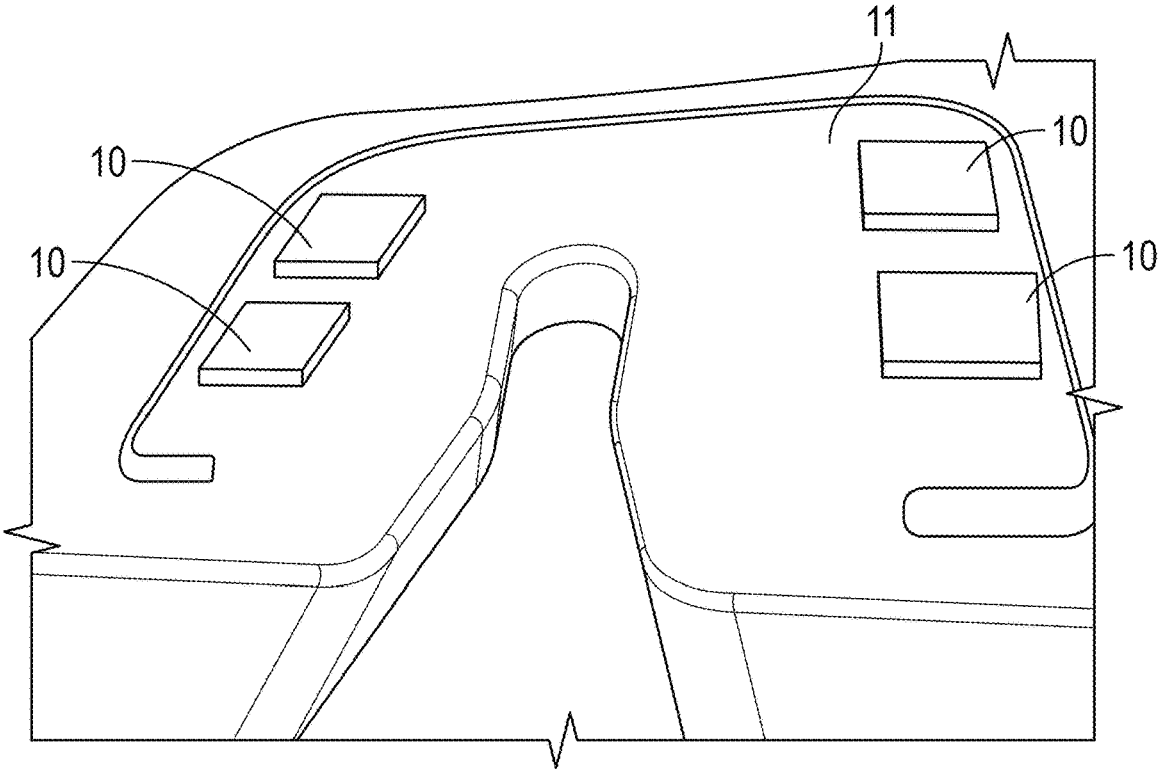
FIG. 3 is an illustration of a fifth wheel showing a number of lubricant pads laid onto the surface of the fifth wheel, with the lubricant pads in the "solid form" before being exposed to pressure and shear forces.
Figure 4:
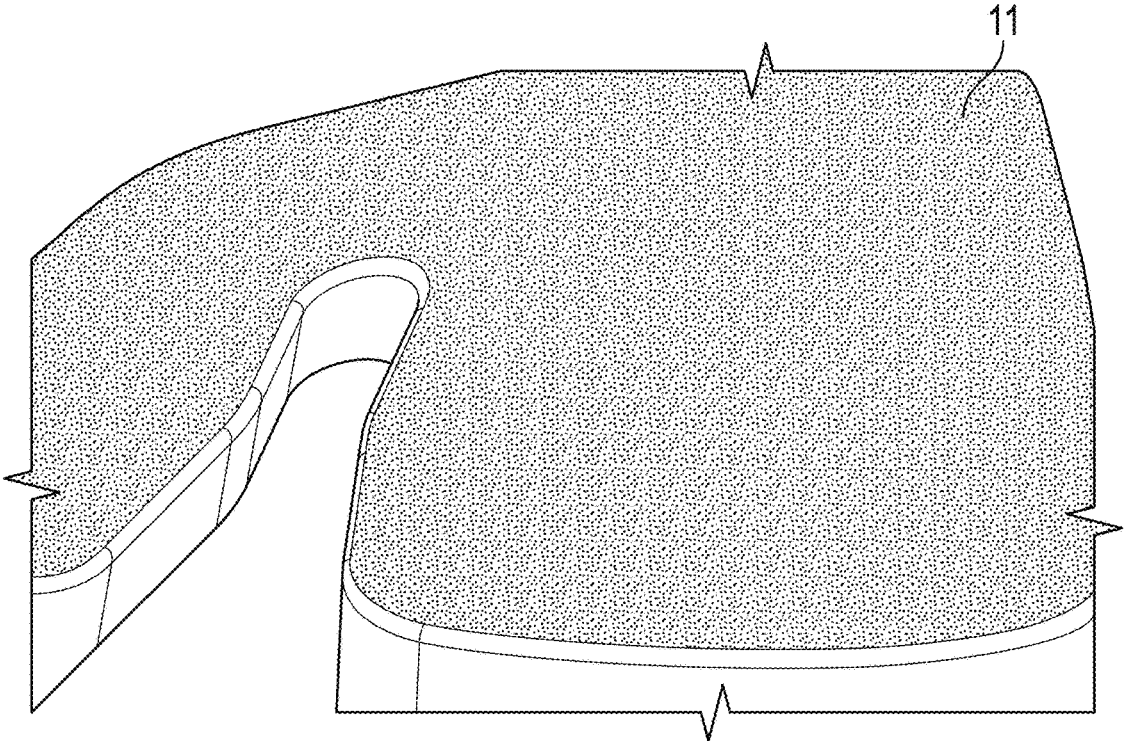
FIG. 4 is an illustration of the fifth wheel showing transformation of the pad to a semi-solid lubricant after being exposed to pressure and shear forces of the fifth wheel plates.

FIG. 3 shows a typical arrangement of lubricant pads applied to a fifth wheel hitch plate 11. However, an operator can choose to apply any number of such pads to the surface of the fifth wheel and in any position deemed necessary. Once the weight of the trailer has been applied to the fifth wheel, the lubricant pad will transform into a thin semi-solid form. As shown in FIG. 4 its physical appearance will change substantially spontaneously to resemble that of a semi-solid grease. As the truck and trailer combination are driven, the turning action of the vehicle will cause the now semi-solid form of the lubricant pad to be distributed across the surface of the fifth wheel in the exact same fashion that occurs with conventional semi-solid grease products. Furthermore, with repeated stress loading of the lubricant from the action of the joint, the semi-solid form of the lubricant pad will stiffen and develop the same level of tackiness as a conventional semi-solid grease product.

Figure 5:
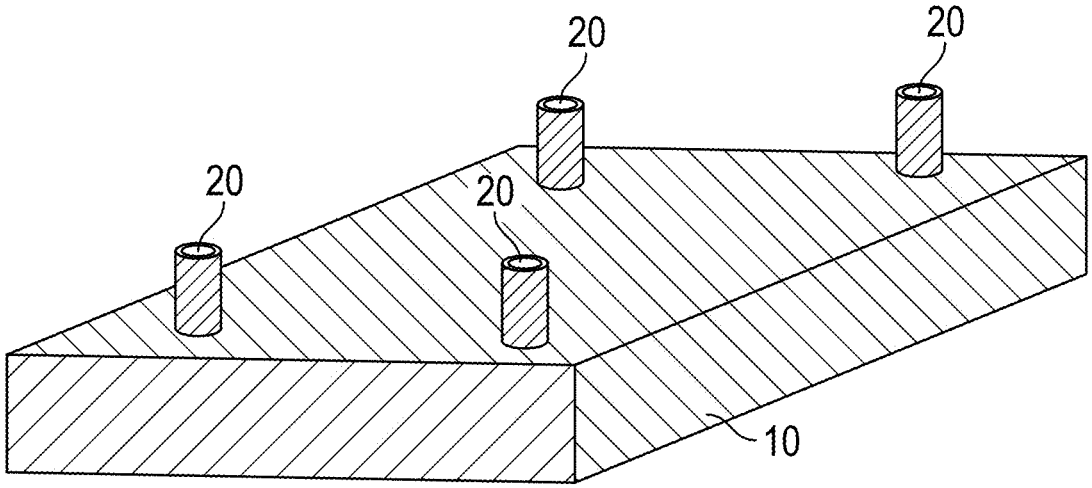
FIG. 5 is a perspective view of another embodiment of a lubricant pad which includes surface posts which enhances the ability of the pad to adhere to a surface.

In terms of the fifth wheel hitch plate application, the surface of the fifth wheel will most often possess an existing layer of previously applied grease on its surface. In such case, the lubricant pad will readily adhere to the existing grease layer. However, there may be a desire to attach the lubricant pad to a completely clean and dry surface which does not include a layer of pre-existing grease, or any such like material. In an embodiment of the current invention, a lubricant pad includes surface features which promote the adherence of said lubricant pad to the surface to which it is to be attached. An example of such a surface feature is represented in FIG. 5. In this example the lubricant pad has been formed with a main body and additionally with cylindrically shaped protruding features, such as a post, a bead or a rib 20. After forming of the main body part along with the added protruding features, the lubricant pad is coated according to a previous description. When the lubricant pad is to be applied to the desired surface, the protruding features 20 will first make contact with the surface prior to the main body making contact. Owing to the geometry of the protruding features, they will readily deform under relatively light hand pressure applied by the operator. Deformation of the protruding features will allow the relatively soft inner core material of the lubricant pad to break through the coating. This relatively soft inner core material will readily attach to the surface to be lubricated. The original protruding features of the lubricant pad have essentially acted as "glue spots" to effect attachment of the pad to the surface to be lubricated. It is understood that many variations of the protruding feature geometry will produce the desired surface attachment effect as was described here within.

Figure 6:
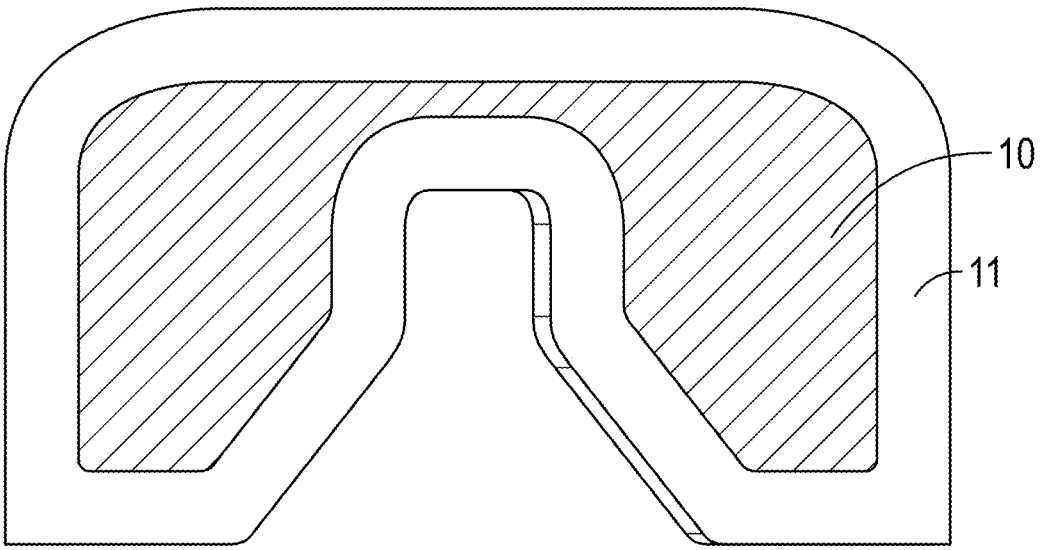
FIG. 6 is a top plan view of another embodiment of a fifth wheel lubricant pad in the approximate shape of the fifth wheel plate.
Figure 7:
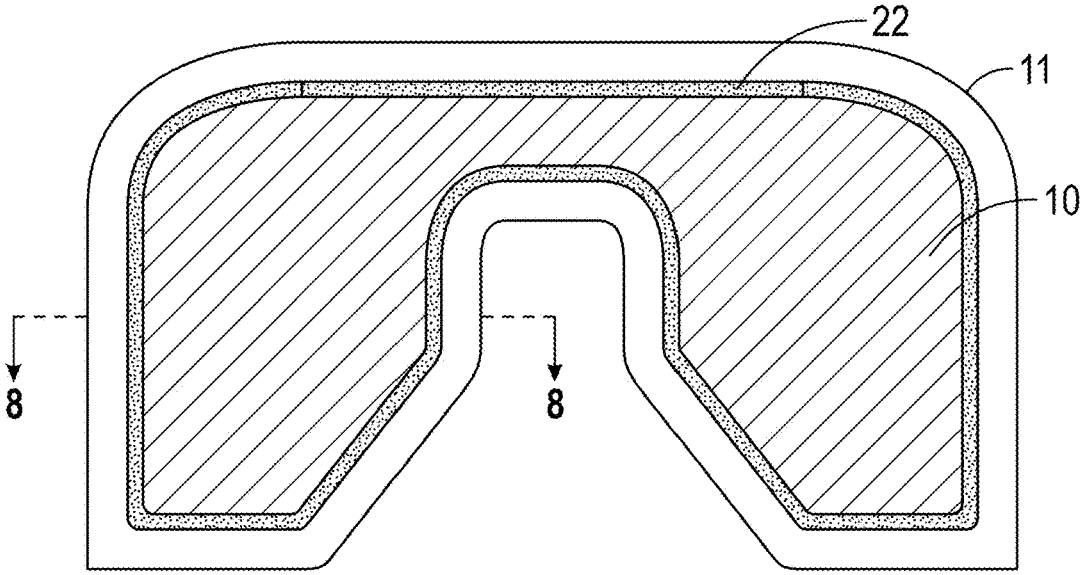
FIG. 7 is a top plan view of a fifth wheel lubricant pad with a "sealing bead" attached to the perimeter edge of the pad and mounted on a fifth wheel plate.
Figure 8:
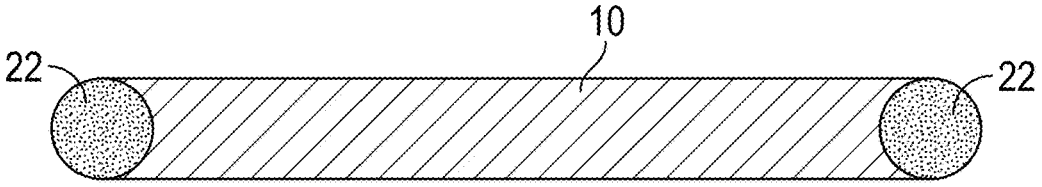
FIG. 8 is a sectional view taken along lines A-A of FIG. 7.
Figure 9:
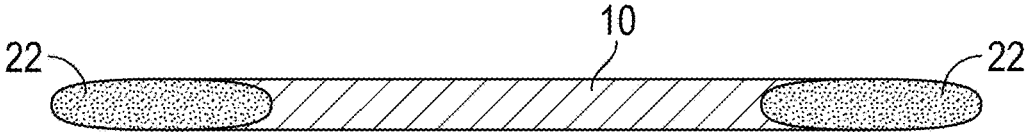
FIG. 9 is a sectional view of the sealing bead of FIG. 7 in its compressed form after the trailer weight has been applied to the fifth wheel.

In a further embodiment of the current invention, a lubricant pad has a geometric form to generally fit or match the shape of the surface being lubricated. For example, as shown in FIG. 6, the geometric form may be a "U" shape which roughly corresponds to the shape of the fifth wheel itself. This form of the lubricant pad will provide the most certain method which results in the spread of lubricant over the entirety of the fifth wheel surface. Beneficial uses of such a lubricant pad geometry are cases in which the fifth wheel surface is new and has no lubricant of any type on its surface; or, all the prior grease has either been intentionally washed of the fifth wheel surface or all the grease has been worn off the surface. A directly related further embodiment is the lubricant pad of FIG. 6 which additionally has a further material attached to the exterior perimeter of the pad as shown in FIG. 7. This additional perimeter of material 22 is bonded to the lubricant pad along the edge of the pad in an essentially bead-like form. The ideal shape of the lubricant pad itself is shown in FIG. 7, though it is understood that the pad may have other shapes. When the surface of the trailer contacts the lubricant pad, the added perimeter material of the pad is compressed into a shape as shown in FIG. 9. The perimeter 22 material is a substantially plastic material such as polyethylene. Owing to the inherent toughness of the polyethylene material, the perimeter bead will remain intact and substantially hold its position under pressure loading due to the weight of the trailer. The perimeter material then has formed a sealing bead around the body of the lubricant pad. The body of the lubricant pad will transform from solid to semi-solid form due to the pressure force and sheer force of the trailer onto the fifth wheel. The perimeter material will act to hold the semi-solid lubricant within the polyethylene beaded perimeter. As such, the substantially improved retention of the semi-solid lubricant will allow the time interval between servicing of the fifth wheel lubricant to be significantly increased.

Figure 10:
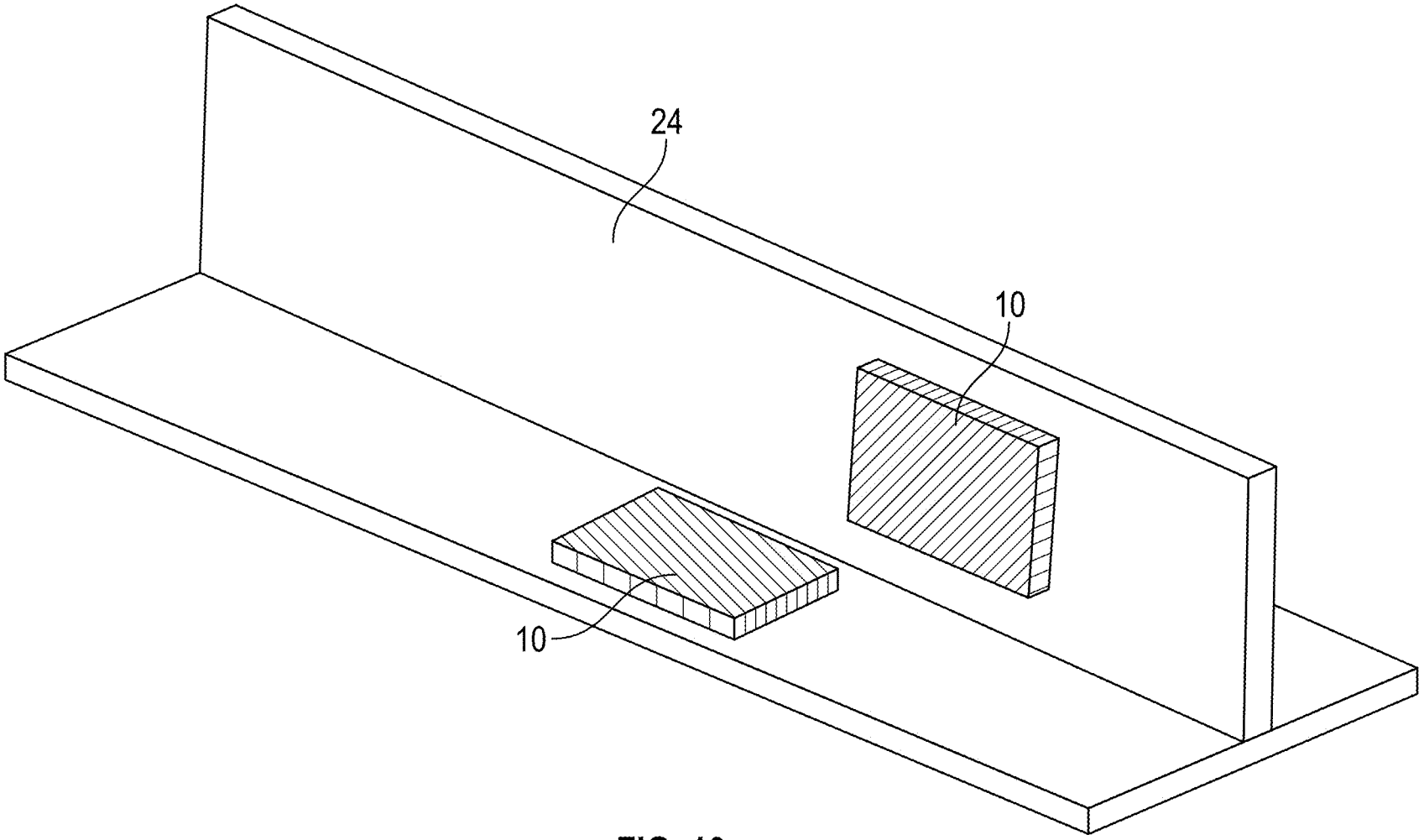
FIG. 10 is a drawing of another application of the lubricant pad concept; a lubricant pad mounted on the rail of a track such as a garage door opener track.

The solid to semi-solid grease of the present invention can be used in various applications, other than on fifth wheels. For example, without limitation, the block can be used to lubricate surfaces such as brakes, machinery, cables, and other objects that need to reduce friction or improve sliding movement. FIG. 10 illustrates another example of application of the grease blocks 10 on a rail of a track 24 along which another surface (not shown) slides.

The grease blocks or pads of the present invention may be packaged individually or may be stacked to provide a set of blocks in a single package. When multiple pads are packaged together, separation sheets, such as wax paper, may be provided between adjacent blocks to make it easy to pull one block from the package for use.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

The invention claimed is:

1. A lubricant, comprising:

a wax infused grease block in solid form at room temperature and transformable to a semi-solid form under mechanical loading; and a dissolvable coating material covering the block to maintain the block in a solid state at temperatures up to 65° C. and at atmospheric pressure.

2. The lubricant of claim 1 wherein the wax is melted and dissolved into the grease, and then cooled to form the solid block.

3. The lubricant of claim 1 wherein the wax is 5-25% by weight of the block.

4. The lubricant of claim 1 wherein the wax is a soy product.

5. The lubricant of claim 1 wherein the block has a bottom surface with deformable protrusions.

6. The lubricant of claim 1 wherein the block has a lower surface with a plastic perimeter bead.

7. A method of creating a solid grease block comprising:

mixing semi-solid grease material with melted wax to form a grease mixture;

cooling the grease mixture to form a solid blocks;

coating the block with a coating mixture of starch and water; and then drying the coating mixture.

8. The method of claim 7 further providing of a plastic bead on one surface of the block.

9. The method of claim 7 wherein the wax is 5-25% by weight of the block.

10. The lubricant of claim 1 wherein the lubricant becomes a semi-solid upon application of increased pressure.

11. The lubricant of claim 1 wherein the coating material includes starch.

12. The lubricant of claim 1 wherein the coating material includes a colorant.

13. The lubricant of claim 1 wherein the coating material includes graphite.

14. The lubricant of claim 1 wherein the coating material includes an adherent.

15. The method of claim 7 further comprising adding an adherent to the coating mixture.

16. The method of claim 7 further comprising adding a colorant to the coating mixture.

17. The method of claim 7 further comprising adding graphite to the coating mixture.

* * * * *